US006109185A

United States Patent [19]

Mikhail

[11] Patent Number: 6,109,185

[45] Date of Patent: Aug. 29, 2000

[54] ANTI-ARMOR PROJECTILE WITH AUTONOMOUS, ATTACHABLE, PRECURSOR WARHEAD

[75] Inventor: Ameer G. Mikhail, Bel Air, Md.

[73] Assignee: The United States of America as represented by the Secretary of the Army, Washington, D.C.

[21] Appl. No.: 09/228,072

[22] Filed: Dec. 31, 1998

[51] Int. Cl.[7] ..... F42B 12/16; F42B 12/18

[52] U.S. Cl. ..... 102/476; 102/438; 102/293; 102/473

[58] Field of Search ..... 102/473, 476, 102/478, 475, 293, 474, 438; 89/6, 6.5

[56] References Cited

U.S. PATENT DOCUMENTS

| | | | |
|---|---|---|---|
| 4,102,271 | 7/1978 | Bethmann | 102/521 |
| 4,497,253 | 2/1985 | Sabranski . | |
| 4,516,502 | 5/1985 | Klein et al. | 102/523 |
| 4,597,333 | 7/1986 | Bocker et al. | 102/518 |
| 4,848,238 | 7/1989 | Bocker et al. . | |
| 4,878,432 | 11/1989 | Mikhail . | |
| 5,003,886 | 4/1991 | Pahnke et al. | 102/521 |
| 5,007,347 | 4/1991 | Greene | 102/473 |
| 5,415,105 | 5/1995 | Voss et al. | 102/476 |
| 5,621,185 | 4/1997 | Spengler et al. | 102/476 |
| 5,744,746 | 4/1998 | Tripptrap et al. . | |
| 5,750,917 | 5/1998 | Seckler et al. | 102/476 |

FOREIGN PATENT DOCUMENTS

435083 A2 7/1991 European Pat. Off. .

*Primary Examiner*—Charles T. Jordan
*Assistant Examiner*—James S. Bergin
*Attorney, Agent, or Firm*—Paul S. Clohan, Jr.; U. John Biffoni

[57] ABSTRACT

Anti-armor projectiles comprising a main projectile having a single warhead, and an additional autonomous precursor warhead which is stowed with the main projectile and attached to the main projectile just before firing, thereby providing a tandem warhead capability and improved lethality for the main projectile. The attachable precursor warhead is packaged with the main projectile so that the length and diameter of the main projectile is not increased while it is stored and until the autonomous precursor warhead is attached just prior to firing. The autonomous warhead may be a chemical energy (CE) warhead or a kinetic energy (KE) warhead so that when attached to existing CE warhead or KE warhead projectiles, tandem CE-CE, tandem CE-KE, tandem KE-KE, or tandem KE-CE warhead projectiles are created. The autonomous, attachable warhead is completely self-contained and prior to firing is affixed to and stowed adjacent the main projectile without exceeding the length and diameter constraints of the main projectile. Thus, tandem warhead capability with its improved lethality is produced for main projectiles having a single warhead with no effect on projectile storage bustle or tank turret designs.

23 Claims, 5 Drawing Sheets

ANTI-ARMOR PROJECTILE WITH AUTONOMOUS, ATTACHABLE, PRECURSOR WARHEAD

GOVERNMENT INTEREST

The invention described herein may be manufactured, used and/or licensed by or for the United States Government.

BACKGROUND OF THE INVENTION

1. Field of the Invention

The present invention relates to anti-armor projectiles and, more particularly, is directed towards anti-armor projectiles comprising a main projectile and an additional autonomous precursor warhead which can be stowed with and attached to the main projectile just prior to firing, thereby providing a tandem warhead capability and improved lethality for the main projectile. More particularly, this invention provides an attachable warhead which is packaged with a main projectile so that the length of the main projectile remains unchanged while it is stored and until the autonomous warhead is attached just prior to firing. The autonomous warhead may be a chemical energy (CE) warhead or a kinetic energy (KE) warhead so that when attached to main projectiles having CE warheads or KE warheads, tandem CE-CE, tandem CE-KE, tandem KE-KE, or tandem KE-CE warhead projectiles are created. As used herein, tandem X-Y indicates that X is the additional precursor, or first warhead to impact the target, and Y is the main or second warhead to impact the target.

2. Description of the Related Art

Chemical energy warheads, also known as shaped-charge warheads, are formed by a metallic liner and an explosive shaped charge, both of which are contained within and carried on board the projectile. The shaped charge is positioned behind the liner, with respect to the direction of flight, so that when the charge is detonated the liner forms a metallic jet directed at the target. The chemical energy warhead must be activated only very near the target at what is known as the "standoff" distance (usually less than 1–2 meters). The standoff is the distance between a chemical energy warhead and the target at the moment of detonation of the shaped or hollow charge. The effect of the warhead depends on the standoff, which is usually optimal at a distance of about 4 times the diameter of the charge. Detonation of the charge at a distance too great from the target results in break-up of the metallic jet and decreased lethality against heavily armored targets.

Standard chemical energy warhead projectiles typically include a spacer or spike located at the front end of the projectile to provide the aforementioned standoff distance. When an impact fuse is mounted on the tip of the spacer, it detonates the shaped charge at the moment of impact so that the jet is formed within the standoff distance from the target. Alternatively, a proximity fuse may be used in lieu of the impact fuse to ensure detonation at a proper standoff distance.

Anti-armor kinetic energy projectiles carry long rods or penetrators which are launched from large caliber gun tubes at very high velocities. For effective lethality, these velocities are usually several times the speed of sound. The mass of these projectiles, along with the speed, determines the kinetic energy that will be transferred to the target on impact. This kinetic energy, E, is represented by $\frac{1}{2}(\text{mass})\times(\text{velocity})^2$. The objective of these projectiles is to penetrate heavy armor and other targets with the most energy and lethality, therefore, the penetrators are usually made of high-density materials such as depleted uranium or tungsten.

Tandem warheads are well known in the art, having been designed for missile systems over the past two decades. "Tandem" refers to two or more warheads (usually CE-CE in missiles) of similar or different diameters being carried on board the same missile. These tandem (CE-CE) warheads are known to be effective against reactive armor, where the first (usually called precursor) warhead activates the armor while the second main warhead follows to defeat the target. See, for example, U.S. Pat. Nos. 4,848,238 and 5,744,746 for tandem CE-CE warheads of the prior art. Tandem chemical energy warheads are used worldwide in missile systems, for example, in the modified TOW missile family series. "Dual" warheads are sometimes used in missiles, for example, to produce top-attack explosively formed projectiles (EFPs), but dual warheads differ from tandem warheads in that dual warheads are not designed to hit the same point on the target.

For projectile applications, tandem kinetic energy warheads (KE-KE) are also known in the art. For example, see U.S. Pat. No. 4,878,432 for a multistage kinetic energy penetrator. In addition, hybrid chemical energy-kinetic energy (CE-KE) tandem warhead projectiles are also known in the art. The French are known to have designed a CE-KE tandem projectile with an impact fuse for the front CE warhead. Furthermore, see U.S. Pat. No. 4,497,253 for a CE-KE tandem warhead having a proximity fuse for the front CE warhead. In addition, U.S. Pat. No. 4,102,271 discloses a projectile having a main CE warhead and a forward armor-penetrating device with an axial conduit in communication with the main explosive charge warhead.

In all of this tandem warhead prior art, the two warheads are fixed together as one piece within the projectile body. This arrangement does not pose a problem for missile applications, which are usually not strictly limited or restricted to a particular length or diameter, i.e., the total length or diameter of the missile is not critical. However, for projectile applications the total length of the projectile is limited by the corresponding length available in the munition storage space, for example, in the bustle of a combat tank. The bustle is the munitions storage rack inside the tank. A spacer or spike of about 6–8 inches is usually required at the front of a projectile as the standoff distance ahead of each CE warhead. This will cause a tandem CE-CE projectile to be too long to be practical for handling by soldiers and, more importantly, for storage in current combat tank bustles. Moreover, for current kinetic energy single-warhead long penetrators, the total length of current rod designs is approaching the maximum allowed length in U.S. and NATO tank bustles, with only a few centimeters (or millimeters for some projectiles) to spare. Thus, adding a second chemical energy warhead to current kinetic energy long penetrator warheads is not possible without modification or redesign of the current tank turret, which is a costly and undesirable alternative.

The present invention provides an autonomous precursor warhead that can be attached to main projectiles thereby creating tandem CE-CE, CE-KE, KE-KE, or KE-CE warheads without the need for more storage space in tank turret bustles because the projectile's overall length remains within allowable limits until just prior to firing. The autonomous, attachable precursor warhead is self-contained, packaged with the main projectile, and is attached to the main projectile only just before ramming the projectile inside the gun tube for firing. Thus, it does not require added storage length or space for the munition cartridge. By "autonomous", it is meant here that the attachable precursor warhead is self-contained and requires no external elements for preparation or functioning. In other words, after mounting the attachable warhead to the main projectile, through threads and a screwing motion or by other attachment means, the now tandem warhead projectile would be ready for use and firing.

SUMMARY OF THE INVENTION

Accordingly, it is an object of the present invention to provide an anti-armor projectile comprising a main single warhead projectile and having an additional autonomous precursor warhead which is stowed with and may be attached to said main projectile thereby creating a tandem warhead projectile with enhanced penetrating capabilities, particularly against targets with reactive armor.

It is a further object of the present invention to provide an autonomous precursor warhead which can be retrofitted to existing single warhead projectiles thereby creating a tandem warhead projectile with enhanced penetrating capability.

It is a still further object of the present invention to provide an autonomous chemical energy precursor warhead which can be attached to the main projectile warhead just before loading the projectile into the gun tube for firing.

It is a still further object of the present invention to provide an autonomous kinetic energy precursor warhead that can be affixed to the main projectile warhead just before loading the projectile into the gun tube for firing.

It is a still further object of the present invention to provide an autonomous warhead that can be attached to either chemical energy or kinetic energy main warhead projectiles.

It is a still further object of the present invention to provide an autonomous warhead that can be packaged within the geometric constraints of existing projectiles so that the additional warhead can be used without modification to existing combat tank storage and bustle designs.

It is a still further object of the present invention to provide an attachable, autonomous warhead which can be retrofitted to existing stock of chemical energy and kinetic energy antiarmor projectiles.

It is a still further object of the present invention to provide an attachable warhead which can be quickly affixed to the main projectile during the heat of battle, enabling soldiers to use tandem warheads when required.

It is a still further object of the present invention to facilitate a three-warhead projectile cartridge that can be stored in existing tank bustles.

In accordance with the invention, an attachable and autonomous, i.e., completely self-contained warhead requiring no external elements for use, is packaged adjacent to the nose of the main projectile so that the additional warhead does not add to the length of the main projectile when stored. Means are provided so that the additional precursor warhead can then be quickly removed and attached to the nose of the projectile just before ramming the projectile into the gun tube for launch. The additional warhead or warheads provide enhanced lethality by creating tandem CE-CE, CE-KE, or even KE-KE warhead projectiles.

The foregoing and other objects and advantages of the present invention will appear from the following detailed description. In the description reference is made to the accompanying drawings which form a part hereof, and in which there is shown by way of illustration and not limitation preferred embodiments. Such description does not represent the full extent of the invention, but rather the invention may be employed in different arrangements according to the breadth of the invention as defined in the appended claims.

DESCRIPTION OF THE PREFERRED EMBODIMENTS

Figure 3:
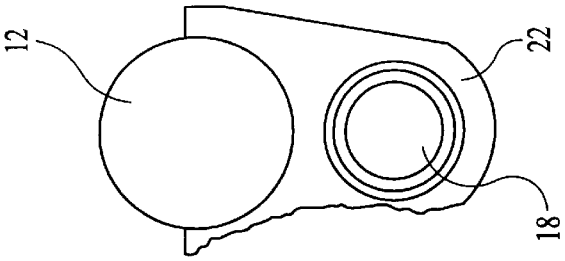
FIG. 3 shows a sectional view taken along line B—B of FIG. 1.

Referring now to the drawings, like reference numerals represent identical or corresponding parts throughout the several views.

Figure 1:
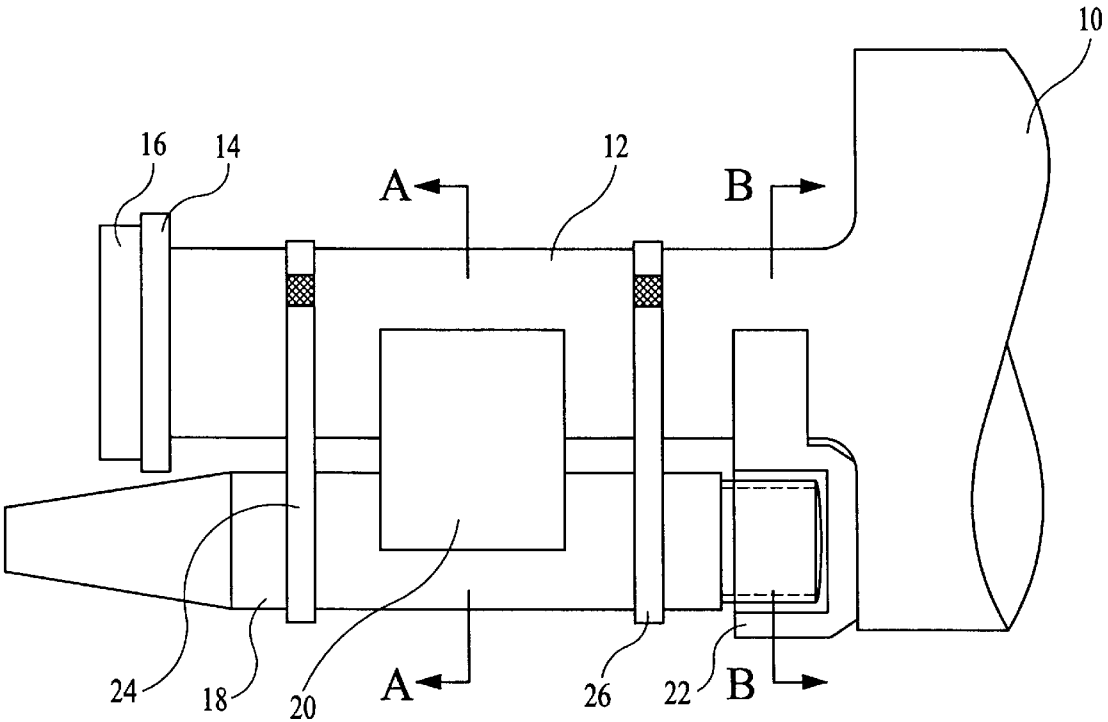
FIG. 1 shows a view of the front end of a CE-CE tandem warhead projectile with its attachable, autonomous precursor warhead in its stowed position adjacent the spacer tube (spike) of the projectile, according to an aspect of the invention.

Turning now to FIG. 1, a view of the front end of a chemical energy-chemical energy (CE-CE) tandem warhead projectile is shown, with the attachable autonomous precursor warhead in its stowed position. Shown is a typical spike-nosed chemical energy projectile body 10 with its spike or spacer 12, and a vortex ring generator 14 near the tip of the spike 12. For the present invention the tip of the common chemical energy projectile is replaced with a threaded plug 16 made of any durable lightweight material such as plastic. Alternatively, the plug 16 may be made of styrofoam and snug-fitted instead of being threaded and screwed in. This eliminates the need for a screwdriver or other tool when removing the plug and reduces the time required during the heat of battle to attach the autonomous warhead. The typical antiarmor chemical energy projectile is a large caliber projectile having a projectile body 10 with a nominal diameter of the order of 100–140 millimeters (mm) for use with large caliber cannons.

The attachable autonomous warhead 18 is also shown in FIG. 1, resting on first support piece 20 and with its threaded back end inserted into a second support piece 22. Both support piece 20 and support piece 22 may be made of any durable lightweight material including styrofoam. The attachable warhead 18 is strapped to the spike or spacer 12 by strapping means, such as strong strapping tape, as shown at the two locations given by 24 and 26. The strapping means 24 and 26 may comprise for example, a tape of fiber reinforced plastic material or thin, high strength, plastic strip with heat welded ends. This strapping material may comprise any suitable tape or other material useful for strapping and supporting structures. Alternatively, the strapping means may comprise a "pull-type" rather than a "cut-type" of strapping material. That is, the strapping material may have a pull-end which can be firmly pulled by the user to cause it to unwrap rather than having to be cut. This would eliminate the need for cutting tool when a cutting tool when attaching the precursor warhead. The strapping means may also comprise a reattachable means such as VELCRO or VELCRO-type straps, i.e., strips with a surface of minute hooks that fasten to a corresponding strip with a surface of uncut pile, where the user would be able to unpack and repack the attachable warhead and its support pieces without tools by using the reattachable straps. However, the strapping means must be sturdy enough to avoid accidental disassembly during casual or unintentional contact at the attachment point. Of course, metal band clamps or any other strapping means utilizing buckles, snaps, screws or other fasteners could also be used. Attention should be paid, however, to ease and quickness of removal particularly under battlefield conditions.

Figure 2:
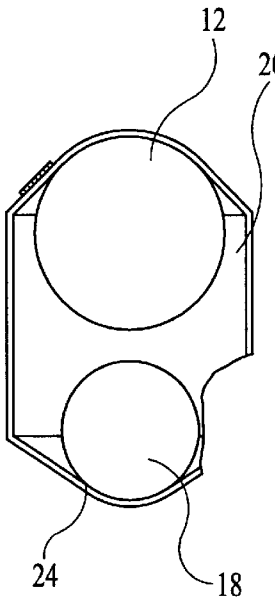
FIG. 2 shows a sectional view taken along line A—A of FIG. 1.

FIG. 2 shows a sectional view taken along line A—A of FIG. 1, showing the strapping means 24 securely holding the attachable, autonomous warhead 18 in its stowed position engaged against the outer contour of the first support piece 20 and secured to the spacer or spike 12 of the main chemical energy projectile.

Figure 4:
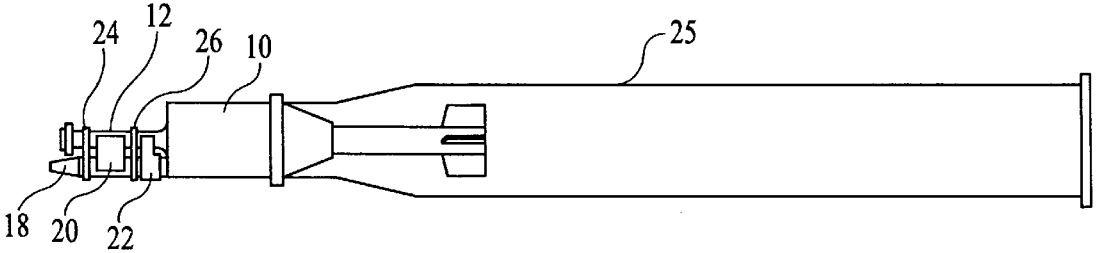
FIG. 4 shows a view of the full CE-CE munition with its cartridge case and the CE precursor warhead in its stowed position adjacent the projectile spacer (spike).

FIG. 3 provides a view taken along line B—B of FIG. 1, showing the second support piece 22 housing the threaded end at the back of the attachable warhead 18, and again resting on and secured to the spacer 12 of the main chemical energy projectile. The overall munition cartridge 25, which the chemical energy projectile 10 of FIG. 1 is normally a part of, is shown in FIG. 4. FIG. 4 is provided to show the overall standard munition configuration, but does not show the contents of the cartridge case, i.e., the propellant charge, the primer rod, and the base igniter, because these components are unrelated to the claims of the present invention.

Figure 5:
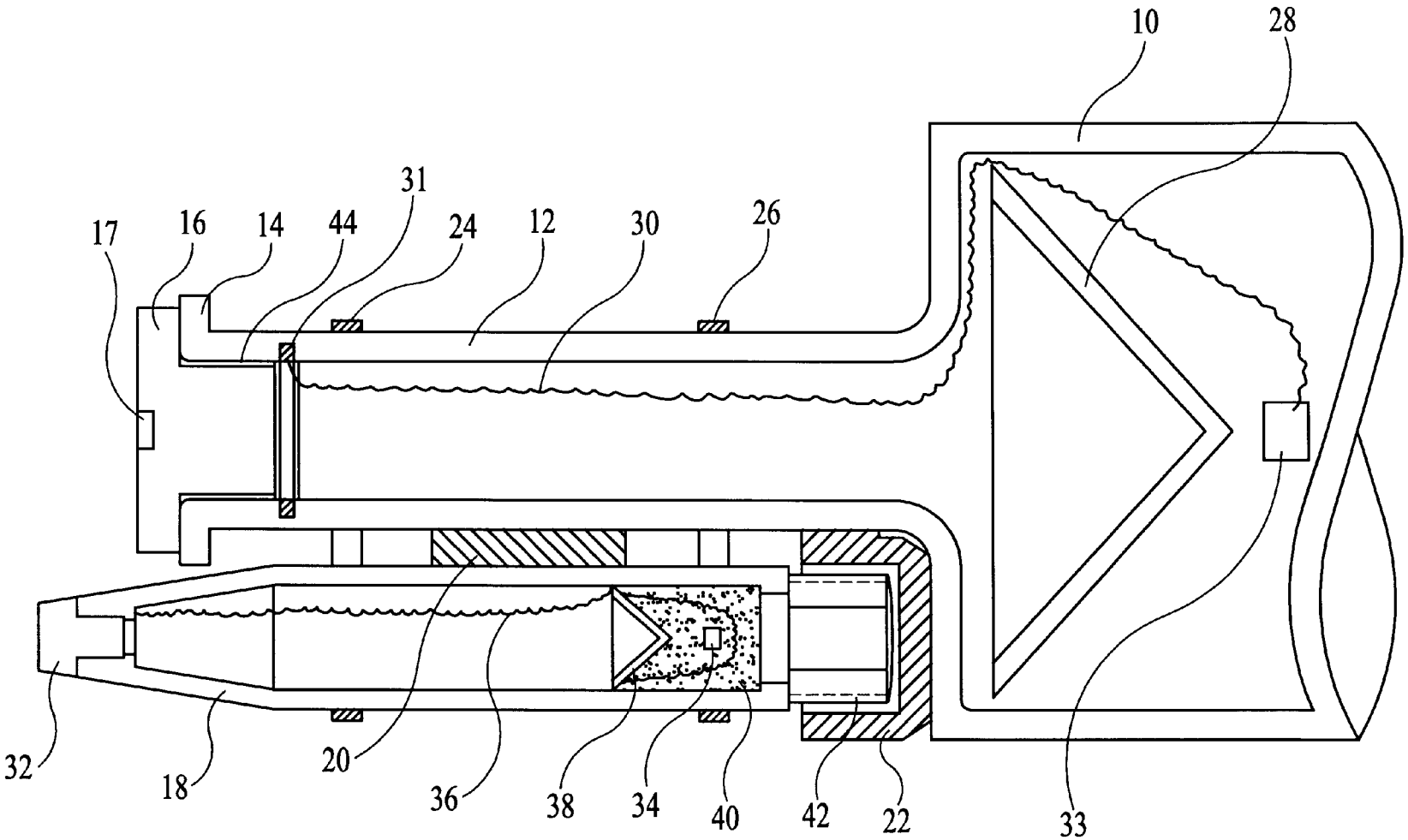
FIG. 5 is a longitudinal sectional view of the front end of the CE-CE tandem warhead projectile with its attachable, autonomous warhead shown in its stowed configuration as in FIG. 1.

FIG. 5 shows a longitudinal sectional view of FIG. 1, with the attachable warhead 18 in its stowed position adjacent the main projectile spacer 12. The main warhead liner cone 28 of the main projectile 10 is shown, as is the connecting wire 30 which leads from the fuse 31, which may be of an impact or proximity-type, to the main shaped-charge igniter 33. Plug piece 16 is shown having an engraved slot 17 which aids in plug removal if plug 16 is threaded, or in pulling plug 16 if it is snug fitted. Attachable, autonomous warhead 18 includes a fuse 32, which again may be of either impact or proximity-type, connected to shaped charge igniter 34 through connecting wire 36. The igniter 34 is positioned behind the liner cone 38 and embedded within the shaping charge explosive 40 of the warhead 18. The attachable, autonomous warhead 18 ends with a threaded back end 42, made to be screwed to the corresponding threads 44 located inside the tip of the spacer 12 of the main chemical energy projectile 10.

Figure 6:
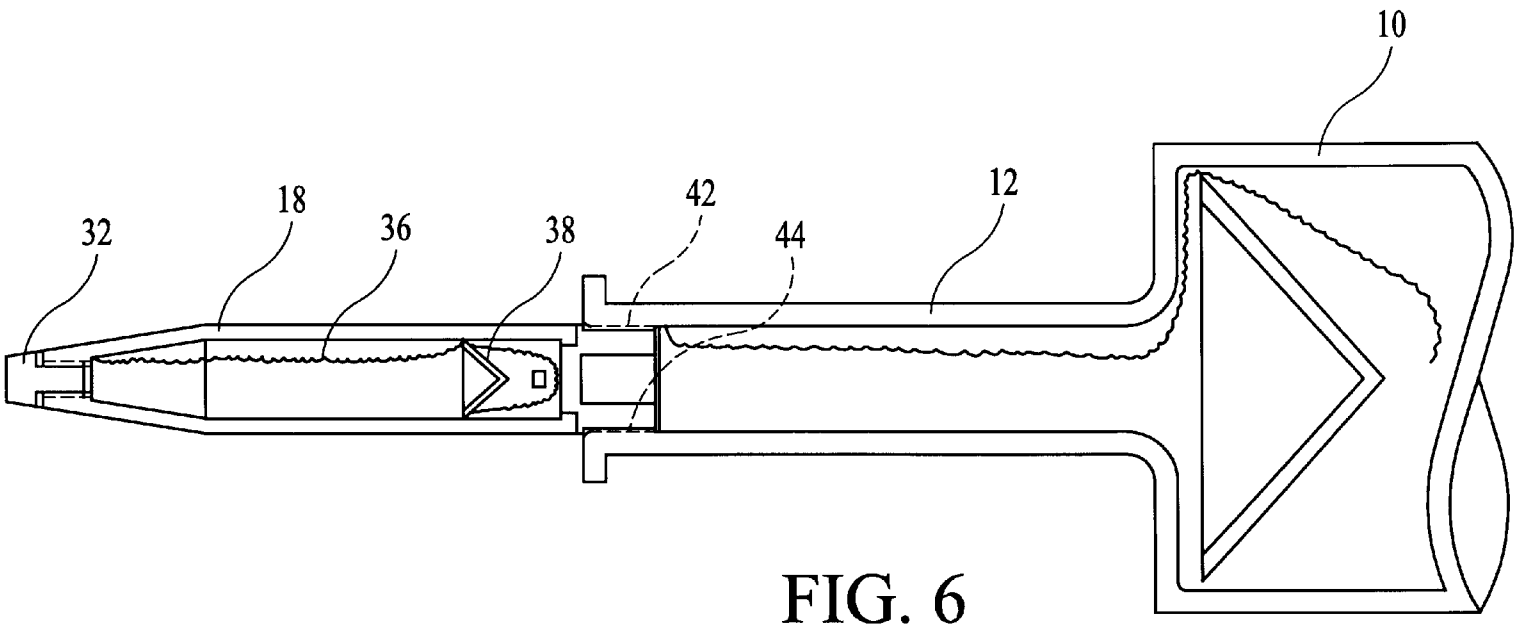
FIG. 6 is a longitudinal sectional view of the front end of a CE-CE tandem warhead projectile showing the precursor warhead in its attached position ready for firing.
Figure 7:
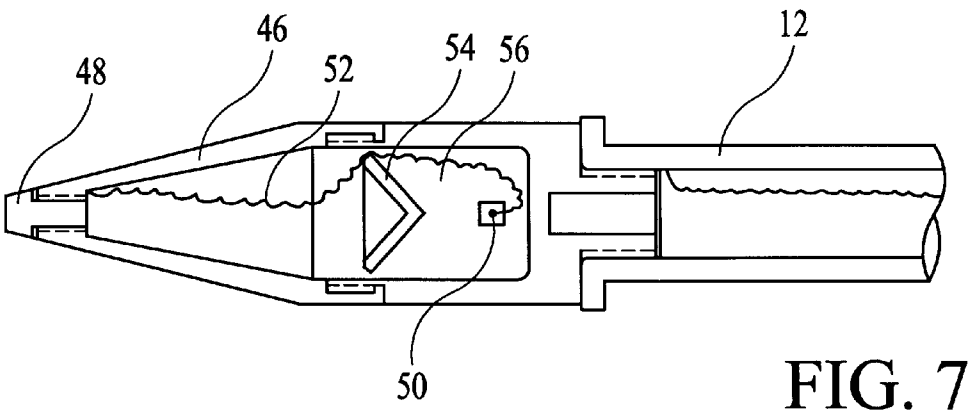
FIG. 7 shows a longitudinal sectional view of the front end of another embodiment of the CE-CE tandem warhead projectile showing the precursor warhead attached and ready for firing, wherein the precursor warhead is larger in size than that of FIG. 6.

The configuration of the tandem CE-CE warhead projectile after attachment of the autonomous warhead 18 to the main projectile 10, as it would appear before ramming into the gun tube and firing, is shown in FIG. 6. FIG. 7 shows, as an alternative, a larger attachable warhead 46 which would provide enhanced lethality for the tandem warheads. Means for stowing and attaching the larger attachable warhead 46 would be identical to that described in the foregoing description of attachable warhead 18.

To be effective against reactive armor, the precursor chemical energy warhead 18 or 46 must be capable of detonating the reactive charge behind the armor plates of the target. This may require the precursor warhead to be of a specific minimum diameter. FIG. 7 shows such a variation in diameter size. However, the size (diameter) of the attachable warhead 46 must be weighed against the large aerodynamic drag the increased size causes and, thus, the shorter effective range that such a projectile will have. The attachable, autonomous warhead 46 of FIG. 7 encases the same warhead components as previously described. These include an impact or proximity-type fuse 48 connected to a shaped charge igniter 50 through connecting means 52, said igniter 50 being embedded within explosive shaped charge 56, both of which are placed behind a precursor warhead liner cone 54.

Figure 8:
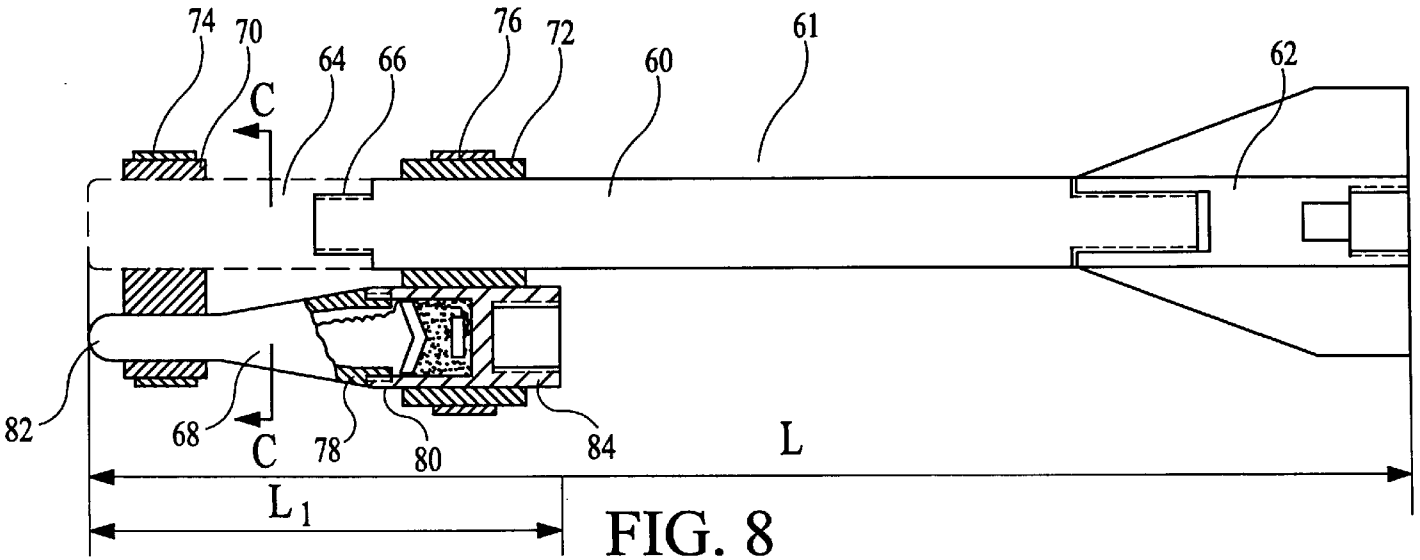
FIG. 8 is a longitudinal sectional view of the front end of a CE-KE warhead projectile with the precursor CE warhead in its stowed position.

A second embodiment of the present invention comprises chemical energy-kinetic energy (CE-KE) tandem warhead configurations as shown in FIG. 8. The main kinetic energy projectile 61 includes a penetrator rod 60 which is attached at its back end to a stabilizing fin piece 62, and at its front end to a covering end piece 64 through threads 66. The covering end piece 64 may be made of any light metal, plastic, or hard styrofoam. The length L in FIG. 8 represents the maximum length allowed for the main projectile 61 so that it can be stored in existing combat tank bustles. The attachable, autonomous chemical energy warhead 68 is also shown in its stowed position and having length $L_1$. Although not shown in FIG. 8, the attachable warhead 68 includes all the components of the previously described precursor chemical warhead including an impact or proximity-type fuse, a metal liner, shaped explosive charge, igniter, and means for connecting said fuse and said igniter. When stowed, the attachable warhead 68 rests on a first support piece 70 and a second support piece 72, and is strapped to the main projectile rod 60 and end piece 64 through strong strapping means, preferably at two locations as given by 74 and 76.

Figure 8A:
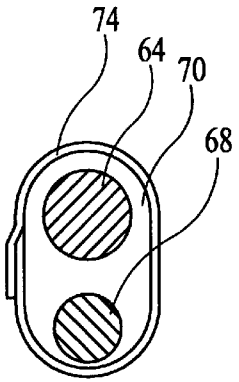
FIG. 8*a* shows a sectional view taken along line C—C of FIG. 8.

FIG. 8*a* shows a sectional view taken along line C—C of FIG. 8, showing the first support piece 70 surrounding the attachable warhead 68 and the main projectile end piece 64, all being held in place by strapping tape 74. Here the support piece 70 is shown surrounding both the main rod front-end piece 64 and the attachable warhead 68, but any embodiment for this support piece which will securely hold the attachable warhead 68 to the main rod 60 may be used. As in any of the foregoing embodiments, the strapping means may simply comprise a strong strapping tape, pull-type tapes, VELCRO tape, or VELCRO-type straps. The strapping means must be simple and quick to remove, while being sturdy enough to avoid accidental disassembly during casual or incidental contact.

For this embodiment, the attachable warhead 68 is comprised of two pieces, front piece 78 and back piece 80, to facilitate the assembly and insertion of inner components of the warhead. This two-piece configuration is not a requirement for the warhead 68, but is intended to facilitate manufacturing and assembly of the warhead 68 which may be of smaller diameter when attaching to KE main projectiles. The tail end of warhead 68 includes a threaded cavity 84 having threads which mesh with corresponding threads 66 on the main projectile rod 60. When a tandem CE-KE warhead is desired for firing, the strapping means 74 and 76 are removed from the attachable warhead 68 and the covering end piece 64 is removed from the main projectile rod 60. The attachable autonomous warhead 68 is then simply screwed on the main rod 60 by matching threaded cavity 84 to threaded end 66.

Figure 9:
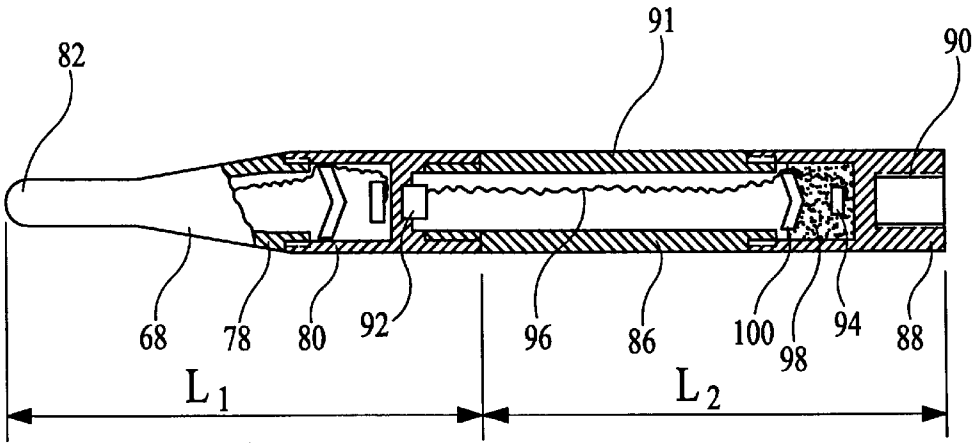
FIG. 9 is a longitudinal sectional view showing a CE-CE precursor warhead which can be attached to the main projectile to create a three-warhead, CE-CE-CE or CE-CE-KE, embodiment of the present invention.

In another embodiment of the present invention, more than one chemical energy warhead may be attached to the main projectile. For example, as shown in FIG. 9, two CE warheads can be attached to the KE penetrator rod 60 to produce a CE-CE-KE tandem warhead. In this configuration, the intermediate CE warhead 91 of length $L_2$ is also made of two hollow cylindrical pieces 86 and 88, to facilitate the assembly and insertion of inner components. The back end of the intermediate warhead 91 includes a threaded cavity 90 to be screwed onto the corresponding threaded end 66 of the main projectile rod 60 of FIG. 8. The dual CE precursor warhead arrangement includes an impact fuse 92 connected to an igniter 94 embedded in shaping charge 98 behind a liner cone 100 by a connecting means 96. The dual precursor warhead comprises a one-piece attachable warhead to be packaged with the main projectile in a manner similar to that described for the foregoing embodiments having only a single precursor warhead. One should note that the combined length $L_1+L_2$ when mounted on the main projectile rod 60 will exceed the maximum allowable storage length L. Thus, the present invention circumvents this limitation on projectile length, while still enhancing the penetration capability of the single warhead projectile by adding two precursor warheads.

Figure 10:
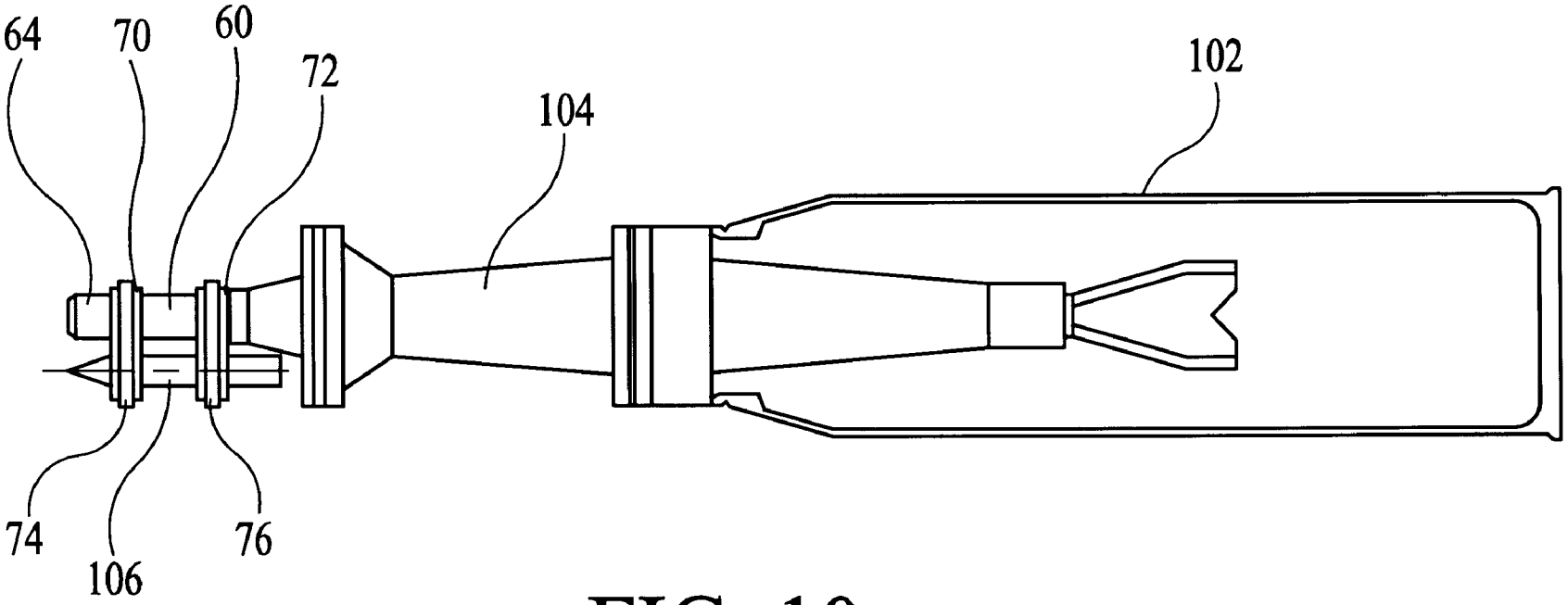
FIG. 10 shows a view of the full KE-KE munition with its cartridge case and the KE precursor warhead in its stowed position adjacent the main projectile penetrator rod.

Finally, another embodiment of the present invention includes the use of an attachable kinetic energy precursor warhead stowed with and attachable to a kinetic energy main projectile rod. FIG. 10 shows the overall KE projectile munition cartridge 102, with rod sabot 104. The attachable KE warhead 106 is secured to the main warhead KE rod 60 by means of the two support pieces 70 and 72 and the strapping tape 74 and 76. The attachable warhead 106 comprises another solid, high-density metal rod piece. When the precursor warhead 106 is attached to the main projectile, this produces a KE-KE rod which may have a length to diameter ratio (l/d) of 40–50. Again, this will enhance lethality of the penetrator without increasing the length of the main projectile when it is stowed. Of course, slight increases in aerodynamic drag must also be taken into consideration to avoid decreasing the terminal effectiveness of the projectile to unacceptable levels.

Obviously, numerous modifications and variations of the present invention are possible in light of the above teachings. It is therefore to be understood that while the invention has been described in this specification with some particularity, it is not intended to limit the invention to the particular embodiments provided herein. On the contrary, it is intended to cover all alternatives, modifications, and equivalents as may be included within the spirit and scope of the invention as defined in the appended claims.

What is claimed is:

1. An anti-armor projectile, comprising:

(a) a main projectile having a main projectile warhead contained therein;

(b) at least one additional autonomous, attachable warhead;

(c) means for stowing said autonomous, attachable warhead in a stowed position and attached to an exterior surface of said main projectile so that the overall length of said main projectile is not increased; and (d) means for attaching said autonomous, attachable warhead in a firing position on said main projectile warhead so that a tandem warhead projectile is created at will prior to firing.

2. The projectile of claim 1, wherein said autonomous, attachable warhead comprises a chemical energy shaped-charge warhead.

3. The projectile of claim 2, wherein said shaped-charge warhead includes an impact initiated fuse.

4. The projectile of claim 2, wherein said shaped-charge warhead includes a proximity fuse.

5. The projectile of claim 2, wherein said main projectile warhead comprises a chemical energy shaped-charge warhead.

6. The projectile of claim 2, wherein said main projectile warhead comprises a kinetic-energy rod penetrator warhead.

7. The projectile of claim 1, wherein said autonomous, attachable warhead comprises a kinetic-energy penetrator rod warhead.

8. The projectile of claim 7, wherein said main projectile warhead comprises a kinetic-energy long rod penetrator warhead.

9. The projectile of claim 1, wherein said autonomous, attachable warhead comprises a plurality of chemical energy warheads.

10. The projectile of claim 9, wherein said attachable warhead comprises two chemical energy warheads placed in tandem.

11. The projectile of claim 9, wherein said main projectile warhead comprises a chemical energy shaped-charge warhead.

12. The projectile of claim 9, wherein said main projectile warhead comprises a kinetic-energy rod penetrator warhead.

13. The projectile of claim 1, wherein said means for stowing said autonomous, attachable warhead comprises:

(a) at least one support piece for holding said autonomous warhead in a position adjacent to said main projectile; and (b) means for strapping said autonomous warhead against said at least one support piece and to said main projectile.

14. The projectile of claim 13, wherein said at least one support piece comprises two support pieces for holding said autonomous warhead to said main projectile.

15. The projectile of claim 13, wherein said at least one support piece is made of a light durable material.

16. The projectile of claim 13, wherein said at least one support piece is made of a plastic material.

17. The projectile of claim 13, wherein said support piece is made of STYROFOAM.

18. The projectile of claim 13, wherein said means for strapping comprises a strapping tape.

19. The projectile of claim 18, wherein said strapping tape includes a pull-end to facilitate quick removal.

20. The projectile of claim 13, wherein said strapping means comprises straps having VELCRO-type strips for attachment.

21. The projectile of claim 13, wherein said strapping means comprises a metal band clamp.

22. The projectile of claim 1, wherein said attaching means comprises a matching threaded fastener configuration for said autonomous warhead and said main projectile warhead so that said autonomous warhead can be screwed onto said main projectile warhead prior to firing.

23. A method of producing tandem warhead capability for main projectiles having only a single warhead, comprising:

(a) stowing an attachable, autonomous warhead in a stowed position and attached to an exterior surface of said main projectile and within the maximum length and diameter constraints for said main projectile;

(b) removing said autonomous warhead from said stowed position; and (c) attaching said autonomous warhead in a firing position on said main projectile warhead prior to firing.

* * * * *